US005594407A

United States Patent [19]

Caddock, Jr.

[11] Patent Number: 5,594,407

[45] **Date of Patent: *Jan. 14, 1997**

[54] DEBRIS-REDUCING FILM-TYPE RESISTOR AND METHOD

[75] Inventor: Richard E. Caddock, Jr., Winchester, Oreg.

[73] Assignee: Caddock Electronics, Inc., Riverside, Calif.

[ * ] Notice: The term of this patent shall not extend beyond the expiration date of Pat. No. 5,481,242.

[21] Appl. No.: 274,018

[22] Filed: Jul. 12, 1994

[51] Int. Cl.[6] ..... H01C 7/10

[52] U.S. Cl. ..... 338/24; 338/275; 338/308; 338/314

[58] Field of Search ..... 338/24, 306, 308, 338/314, 275

[56] References Cited

U.S. PATENT DOCUMENTS

| | | | |
|---|---|---|---|
| 3,648,212 | 3/1972 | Kuwabara et al. | 338/53 |
| 3,778,644 | 12/1973 | Brandi | 338/260 |
| 3,792,406 | 2/1974 | Kreifels | 337/163 |
| 3,978,443 | 8/1976 | Dennis | 338/309 |
| 4,101,820 | 7/1978 | Montanari | 323/369 |
| 4,297,670 | 10/1981 | Solow | 338/195 |
| 4,467,310 | 8/1984 | Jakab | 338/22 R |
| 4,528,546 | 7/1985 | Paoli | 338/195 |
| 4,630,025 | 12/1986 | Bourolleau | 338/309 |
| 4,809,324 | 12/1989 | Bender | 379/412 |
| 4,939,498 | 7/1990 | Yamada et al. | 338/22 R |
| 4,959,751 | 9/1990 | Hearn et al. | 361/406 |
| 4,961,065 | 10/1990 | Taylor | 338/308 |
| 5,204,799 | 4/1993 | Stibila | 361/104 |
| 5,252,944 | 10/1993 | Caddock, Jr. | 338/275 |
| 5,254,969 | 10/1993 | Caddock, Jr. | 338/308 |
| 5,291,178 | 3/1994 | Strief et al. | 338/226 |
| 5,404,126 | 4/1995 | Kasai et al. | 338/24 X |
| 5,481,242 | 1/1996 | Caddock, Jr. | 338/306 |

FOREIGN PATENT DOCUMENTS

| | | |
|---|---|---|
| 0395231 | 10/1990 | European Pat. Off. . |
| 507465 | 10/1992 | European Pat. Off. . |
| 2109760 | 2/1971 | Germany . |
| 3245629 | 12/1982 | Germany . |
| 2163307 | 2/1986 | United Kingdom . |

*Primary Examiner*—Teresa J. Walberg
*Assistant Examiner*—Raphael Valencia
*Attorney, Agent, or Firm*—Richard L. Gausewitz

[57] ABSTRACT

A resistor combination and method, that is formed by a substrate having a resistive film on it, and pins extruding from one edge of the substrate and connected to the film. A U-shaped cold region is provided on the substrate around at least much of the film, and is so constructed that application of common high overload voltages to the pins causes vertical fracture of the substrate. The resulting substrate pieces are held by the pins to the circuit board. In one embodiment, a synthetic resin housing is provided around the substrate.

14 Claims, 3 Drawing Sheets

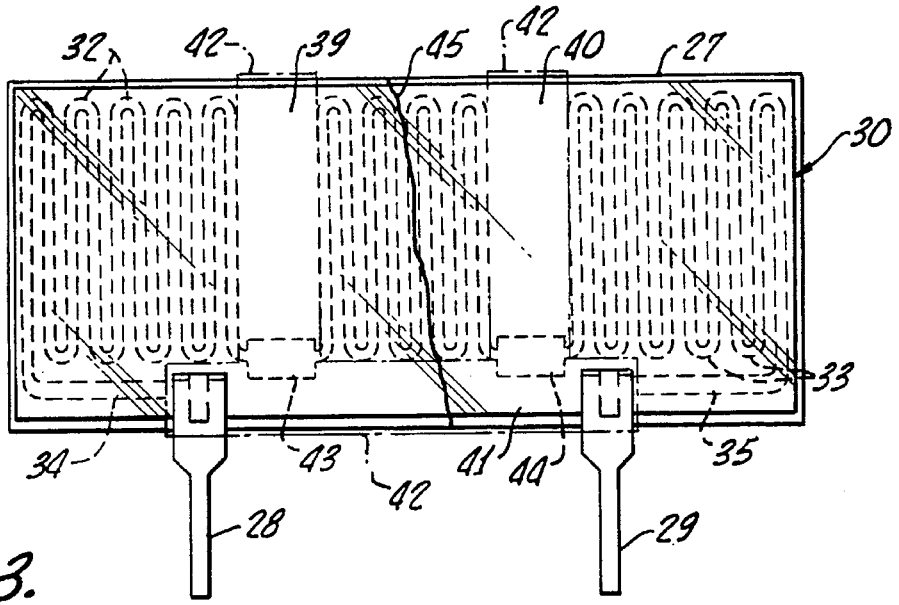
FIG. 3.
FIG. 4.
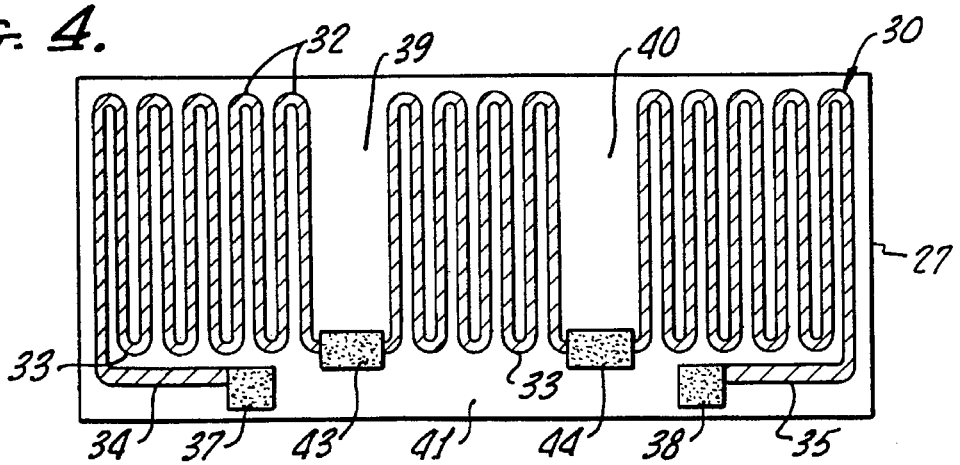

DEBRIS-REDUCING FILM-TYPE RESISTOR AND METHOD

FIELD OF THE INVENTION

This invention relates generally to resistors of the type that fracture in response to high electrical overload.

BACKGROUND OF THE INVENTION

It has long been known that it would be extremely desirable to achieve fracturing resistors that are reliable, fast-acting, practical, commercial, compact and strong, yet such that, in at least the vast majority of cases when fracturing occurs, the resulting debris does not drop onto or away from the circuit boards on which the resistors are mounted. Otherwise, the debris may fall randomly, for example, into the electronic systems (electronics) of which the resistors are part.

Any prior-art fracturing resistors that attempted to achieve debris reduction were unreliable, slow, or otherwise unsatisfactory in operation, or were impractical, excessively large, inefficient, or deficient in other ways.

It would also be extremely desirable to have a very reliable and effective circuit-breaking resistor in a housing—where debris reduction is not a factor.

SUMMARY OF THE INVENTION

It has been discovered that by certain applications of what the applicant terms the principle of U-shaped containment, fracturing resistors (and associated methods) are achieved and are such that the resulting debris remains reliably in place instead of tending to drop onto the circuit board or elsewhere. In resistors where there is a housing, the fracturing is such that the circuit breaking is effective and reliable.

In accordance with one aspect of the present invention, U-shaped cold (relatively cold during electrical overload) regions are provided on the resistors, and terminals are provided at one edge of the resistors, in such relationship that when a high overload occurs, a fracture line (crack) extends generally away from and/or toward that edge having the terminals, so that the terminals remain effective to hold the ceramic substrate in position on the circuit board and no debris can drop onto the board or elsewhere. (It is pointed out that the direction of progagation—whether it starts at the top or bottom or is simultaneous throughout—is irrelevant.)

In accordance with another aspect of the invention, single no-debris resistors (two-terminal resistors) are provided that are practical and effective and operate as circuit-breaking elements.

In accordance with another aspect of the invention, circuit-breaking resistors are provided in a housing, and the circuit breaking is clean and fast and seemingly arc-free; the arc is contained and obscured by the housing.

In accordance with another aspect of the invention, single no-debris, fracturing resistors are provided in which the current-conducting resistive film has a meandering pattern, with a substantial portion of the pattern being serpentine.

In accordance with another aspect of the invention, single no-debris, fracturing resistors are provided in which the current-conducting resistive film has a solid pattern.

BRIEF DESCRIPTION OF THE DRAWINGS

All of the below-described views are elevational views, showing the parts in the orientations that would be assumed when mounted on horizontal circuit boards.

FIG. 3 is a front elevational view of a second embodiment of a single no-debris resistor, and also showing a crack therein;

FIG. 4 corresponds to FIG. 3 but shows only the substrate, metalizations, and resistive film;

DETAILED DESCRIPTION

U.S. Pat. No. 5,254,969 for a Resistor Combination and Method is hereby incorporated by reference herein.

The resistors have thin, flat, square or rectangular substrates. The thermal coefficient of expansion of each substrate is sufficiently high to effect the desired fracturing but not so high that fracturing occurs at excessively low overloads.

There is printed onto each substrate a resistive film (meaning resistance film having a relatively high resistivity—namely a resistivity which is high relative to the resistivity of the connecting metalization—and that accordingly results in generation of substantial heat in the resistant film when current of an appropriate magnitude flows through it).

Two terminals (terminal pins) are connected by soldering to metalization pads at the bottom edge of each substrate and are subsequently soldered into holes in a circuit board CB shown in FIG. 1.

The terminal pins are preferably stiff, so as to keep the substrate sections vertical before and after fracture occurs. The pins are stiffly connected to the substrates.

Figure 1:
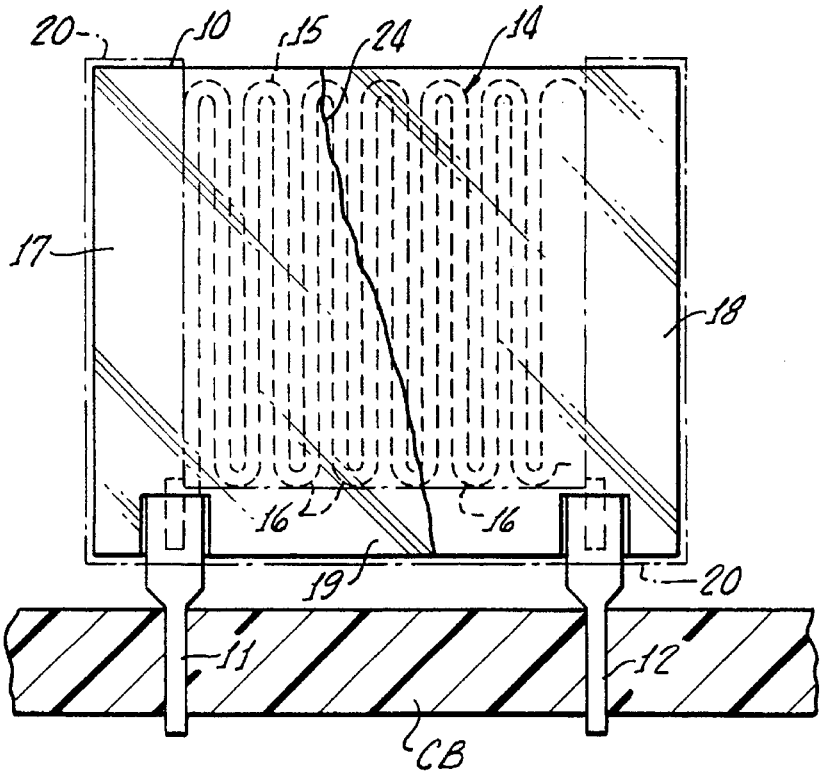
FIG. 1 is a front elevational view of a single no-debris resistor having a fracture crack therein.
Figure 8:
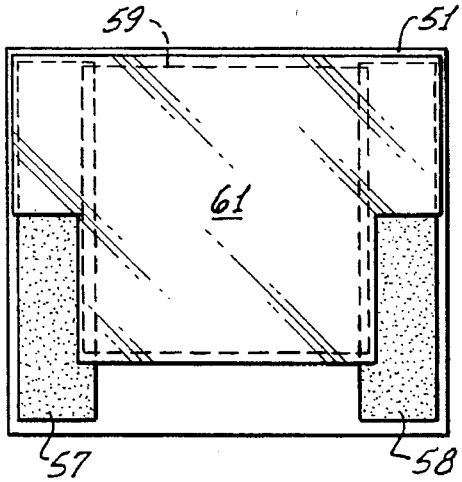
FIG. 8 corresponds to FIG. 7 but shows also the overglaze.

An overglaze is provided, as indicated in FIGS. 1, 3 and 8.

Pre-Description of the Method and of the Operation of the Resistors

As the result of the present articles and method, and in accordance with the invention, fracture (cracking) of substrate 10 is achieved which is reliably and repeatably in generally a particular direction and a particular area. The direction is generally or substantially vertical or transverse relative the bottom edge of each substrate and generally vertical or transverse relative to the top edge. Also in accordance with the invention, each bottom edge is connected to and supported by terminals to a circuit board, so that when the fracture is generally vertical, the pieces of the substrate may not fall onto the circuit board or elsewhere but instead remain in place. However, the fracture is substantially certain to break the circuit through the resistive film so that the desired circuit-breaking or "fuse" action is reliably achieved.

The method is such that the area (location) of the fracture is generally between certain "cold arms". Because of this, and or other reasons, the chances of resistor debris dropping onto the circuit board or elsewhere are reduced to a very low percentage.

To state the above in another manner, the repeatable, substantially vertical fracture is, in accordance with the present method, in the great majority of instances directed toward or away from the terminals (pins) that are electrically and mechanically bonded to the bottom edge of the substrate and to the circuit board. The pieces created by the substantially vertical fracture are then held and may not fall away.

In many cases, the fracture is barely noticeable—being a crack in the substrate without substantial dimensional separation. This crack in the ceramic destroys or greatly damages the support of the resistive film (resistor deposit) which is directly over the crack, thereby causing quick opening (burnout) of the resistor at that location. The circuit is thus opened quickly, typically in a small fraction of a second when the electrical overload is high.

It was originally thought by the applicant that the vertical fracture method required, for most effectiveness, a serpentine or meandering resistive film (resistor) pattern. It has, however, since been learned that the method is also very effective relative to solid (continuous over a substantial area) deposits of resistive material, as subsequently described relative to FIGS. 5–8.

Further in accordance with the method, a particular pattern of what is for convenience called "cold regions," or "cold areas, " or "cold arms, " is intentionally and deliberately created (provided) for the purpose of directing the thermal stress to cause the stated generally vertical fracture of the substrate 10, and thus achieve the "fuse" action described above and below. It is to be understood that there is no generation of "cold" in the refrigeration sense, but instead the absence of generation of heat during high electrical overloads in certain parts of the frontside of the substrate.

The pattern of frontside cold—meaning relative cold in relation to frontside—heated areas—is U-shaped, with the U opening upwardly and having its base at the bottom edge region of the substrate.

To state the method in another way, there is intentionally created what may be termed "U-shaped containment" of a heat—generating area. When an electrical high overload occurs, the heat-generating area defined within the stated U-shaped region—namely, the area between the vertical cold arms of the U—rapidly expands due to the resistor heating and the thermal coefficient of expansion of the ceramic substrate material. This causes increasing strain in the ceramic between the arms of the U due to the thermal contrast in the cold area and the contained, expanding heat-generating area.

Further in accordance with the method, any cold region at the top of the substrate is intentionally made as narrow as practical relative to the three sides of the U to thereby reduce greatly the possibility of random breakage as distinguished from generally vertical breakage. Also, in accordance with the method, the size of the heat-generating area (frontside heating) is intentionally made sufficiently large to achieve the stated expansion of a relatively large area (proportion) of the substrate. Furthermore, and very importantly, each arm of the U is intentionally made sufficiently wide that the cold there maintains sufficient thermal contrast—relative to the thermal conductivity of the substrate—and will contain the heated expanding ceramic so as to result in the desired thermal stress and the fracture described.

The width (horizontal dimension) of each vertical arm of the U is greater than 0.050 inch, preferably greater than 0.060 inch, and in the preferred embodiment of the method (and article) is about 0.1 inch.

The vertical dimension of the base of each cold U is caused to be substantially equal to—or somewhat less than—the horizontal dimension of each cold arm.

It is a feature of the invention that—preferably—use is made of cold (unheated) space which is often present along the bottom edges of many resistors for purposes of terminal attachment, to form the base of each U. This increases the efficiency of utilization of substrate area.

In a form of the invention that is not presently preferred—one reason being that it does not permit many film patterns, or efficient use of substrate area, the cold area is V-shaped instead of U-shaped or substantially U-shaped. With a V-shaped cold region, the resistive film within the V is normally serpentine, the runs of which progressively change in length.

Figure 2:
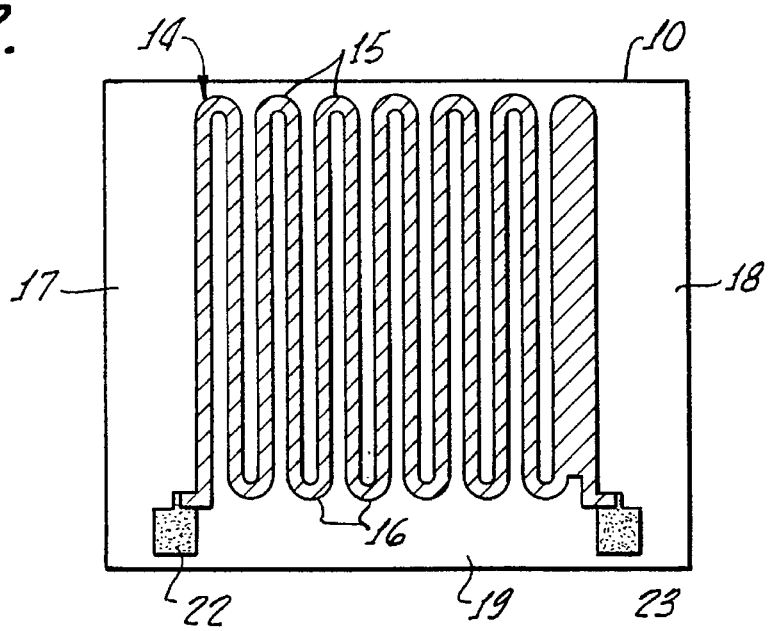
FIG. 2 corresponds to FIG. 1 but shows only the substrate, metalizations, and resistive film.

Description of Method and Article of FIGS. 1 and 2

In FIG. 1 there is shown the frontside of a resistor making use of the U-shaped containment described above. In the present example, the backside is plain—having no film or overglaze but only blind metalization pads for use in soldering of the terminals.

A generally square substrate 10 has terminals 11, 12 stiffly connected thereto as by solder, the terminals in turn being mechanically and electrically connected to circuit board CB.

A serpentine pattern 14 of resistive film, having vertical runs in the present embodiment, is screen-printed onto the frontside of substrate 10. The illustrated serpentine pattern 14 has a horizontal row of loops or corners 15 along the top thereof, and has a horizontal row of loops or corners 16 spaced from the bottom thereof.

The leftmost run of pattern 14 is spaced from the left edge of substrate 10. The rightmost run of pattern 14 (which is shown thick so as to provide for laser trimming in a vertical direction) is spaced from the right edge of substrate 10. Thus, cold arms or areas 17, 18 are formed respectively at the left and right portions of substrate 10.

The bottom corners 16 of pattern 15 are spaced upwardly from the bottom edge of substrate 10, to form a third cold area 19, this being the base of the U.

The top corners 15 are close to the top horizontal edge of substrate 10, so that the frontside heating continues upwardly almost to—or to—such edge.

There is thus defined a U-shaped cold zone consisting of areas 17, 18 and 19. This is generally shown by the indicated phantom line 20.

The ends of the serpentine pattern are connected to metalization pads 22, 23 on the substrate. These, in turn, are stiffly connected by solder to the terminals 11, 12.

In practicing the method with the embodiment of FIGS. 1 and 2, the resistor is connected mechanically and electrically at terminals 11 and 12 to the circuit board CB in fixed relationship. Then, when an electrical overload of a sufficient magnitude occurs, the U-shaped zone generally defined within phantom line 20 contains the frontside heated zone covered by serpentine pattern 14. This creates a relationship by which a crack is formed in substrate 10, between the arms of the U and in a substantially or generally vertical direction. Despite the fact that the runs of the illustrated pattern 14 are vertical, it is substantially impossible for the crack to miss breaking one or more of the resistive runs and/or corners. Accordingly, the circuit between pins 11, 12 is broken. One representative fracture or crack is indicated at 24.

Each vertical arm of the U is caused to have a width (horizontal dimension) of at least 0.06 inch. The bottom (base) of the U is caused to have a vertical dimension of at least 0.06 inch. It has been found that the heated area contained within the U is preferably generally square, since this tends to reduce the widths of the arms (and base) of the U necessary to reliably achieve vertical fracture.

In all embodiments, all of the factors, including gap width, substrate thickness, etc., are intentionally so selected that the substrate fracture is generally vertical as shown and described.

Embodiment of FIGS. 3 and 4

Referring to FIG. 3, there is shown the frontside of an elongate rectangular substrate 27, to the bottom edge of which are soldered two terminals 28, 29. The terminals are spaced inwardly from the opposite ends of the substrate.

A serpentine resistive film 30 is screen-printed onto the frontside of substrate 27. In the present example, the backside of the substrate is plain, not having anything thereon except blind metalization pads for soldering of the terminals 28, 29. Such terminals are mechanically and electrically connected to a circuit board at holes in such board.

The illustrated film 30 is formed with vertical runs that are parallel and adjacent each other, except as stated below. The upper corners, or loops, of the film, numbered 32, are along a horizontal row adjacent the top edge of the substrate 27. The lower corners, or loops, numbered 33, are along a horizontal row spaced upwardly from the bottom substrate edge. Connected to each end of the film 30, relatively adjacent the bottom edge of the substrate and outboard of the terminals 28, 29 are horizontal runs 34, 35. These connect to metalization pads 37, 38 (FIG. 4) to which the terminals are soldered.

The film 30 is not continuous but instead has two longitudinally (spaced longitudinally of the substrate) spaced vertical arms or gaps 39, 40 therein. These arms or gaps 39, 40—and the gap 41 between the bottom edge of substrate 27 and the bottom edge of film 30—are surrounded by a dashed line 42 that is the general perimeter of a U-shaped cold zone.

To maintain the electrical continuity of the circuit, high-conductivity metalization pads 43, 44 are extended across gaps 39, 40 in electrical contact with adjacent portions of the serpentine resistive film. This prevents any substantial heating of the arms or gaps 39, 40.

When a high electrical overload—for the particular industry in which the resistor is used—is applied to the terminals 28, 29, the central region of the serpentine film 30 expands rapidly while the surrounding U-shaped cold area (arms or gaps 39, 40, and 41) expands less rapidly, thus creating the thermal stress and consequent reliably predictable crack or fracture such as is shown at 45 (FIG. 3) and that interrupts and breaks the electrical circuit. The resulting substrate sections are held to the board and cannot fall in any substantial number of instances.

Each gap 39 and 40 has a width of at least about 0.06 inch. The base of the U is about 0.06 inch

Embodiment of FIGS. 5–8

Figure 5:
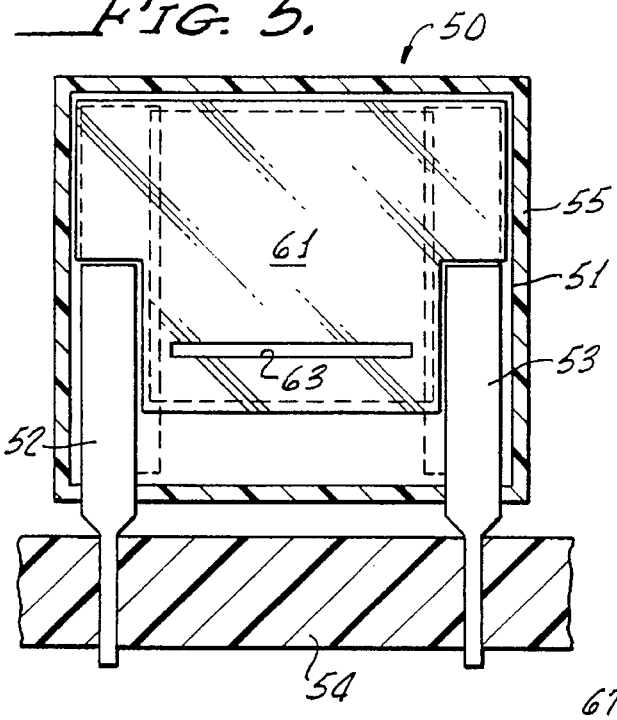
FIG. 5 is a front elevational view of a third embodiment of a single resistor having a housing.

Referring next to FIG. 5, there is shown a resistor 50 having a generally square substrate 51 and having terminals 52, 53 that are soldered into holes in a circuit board 54.

Furthermore, in its illustrated preferred form, resistor 50 has a synthetic resin housing 55 formed (for example) of epoxy of silicone synthetic resin.

Housing 55 is illustrated schematically but is to be understood as corresponding to the housing shown and described in U.S. Pat. No. 5,252,944, except that the synthetic resin is preferably not the high thermal-conductivity type. Said patent is hereby incorporated by reference herein.

Figure 6:
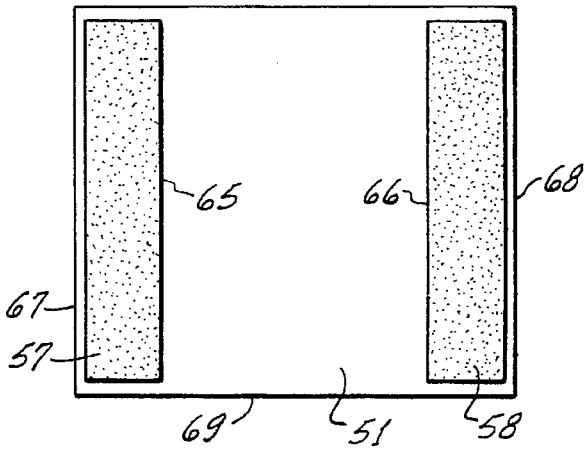
FIG. 6 shows only the ceramic and metalization of the embodiment of FIG. 5.
Figure 7:
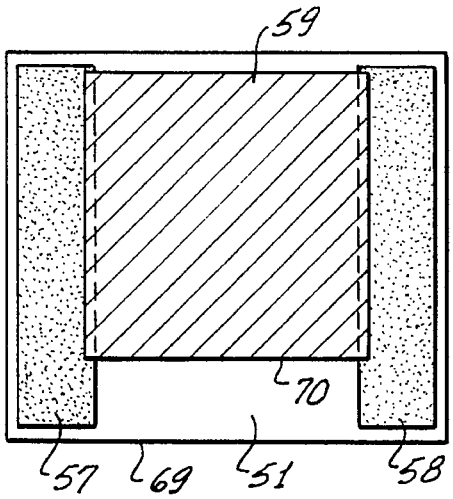
FIG. 7 corresponds to FIG. 6 but shows also the resistive film.

As shown in FIGS. 6, 7 and 8, substrate 51 has vertically elongate, rectangular high-conductivity metalizations 57, 58 along the left and right edge portions thereof. A substantially square solid resistive film 59 (FIG. 7) is screen-printed onto substrate 51, having its top edge near the top edge of the substrate, and having its bottom edge spaced from the bottom edge of the substrate.

The vertical side edges of film 59 overlap just the inner vertical edge portions of metalizations 57, 58 (FIG. 7).

A glass coating 61 is provided over resistive film 59, and over the upper metalization portions, and overlaps the edges thereof.

The terminals 52, 53 have wide upper portions that overlap large parts of metalizations 57, 58 and are soldered thereto by layers of solder. There are thus low-resistance connections to the metalizations and thus to the side edges of the resistive film 59.

The value of the resistance is trimmed by a horizontal slot 63 (FIG. 5) that is laser cut through the glass and through the resistive film. The slot is parallel to the direction of current flow through the resistive film.

The resistor of FIGS. 5–8 operates also as a "fuse" or circuit breaker, achieving a clean "vertical" fracture in response to sufficiently high overload voltages. Exemplary vertical fractures would correspond to those shown in FIGS. 1 and 3. The vertical fractures break the circuit between the terminals, as previously described.

If the fracture resulting from high overloads were random instead of vertical, the circuit would often not be broken, or only partially broken, by the fracture—so that there would then not be rapid and complete cessation of current flow.

Because there is vertical fracture instead of fracture at the corners of the substrate, there is no need for vertical metalization traces at the vertical edges of the substrate. Accordingly, there is much room at such vertical edges for the above-described terminals 52, 53 of any desired length. Accordingly, the surface area of the substrate is efficiently used.

To achieve vertical fracture reliably and repeatably, the above-described U-shaped containment is effected. Thus, the horizontal distance between each inner metalization edge 65 and 66 (FIG. 6) and each outer vertical substrate edge 67 and 68 is caused to be substantially equal to (or somewhat greater than) the vertical distance between the bottom substrate edge 69 (FIG. 7) and the bottom edge 70 of the resistive film 59. Stated otherwise, the 69–70 distance is substantially equal to the 65–67 distance and also the 66–68 distance.

Additional Disclosure

In all of the embodiments of FIGS. 1–8, inclusive, there is preferably the same substrate material having the expansion characteristics stated above. This is preferably aluminum oxide, as described in the cited patents. The thickness of the thin, flat substrate may vary, with the thinner substrates fracturing more rapidly than those less thin. Typical thicknesses are 0.025 inch, 0.030 inch, 0.035 inch, and 0.040 inch.

The metalizations and resistive films of the embodiments of FIGS. 1–8 are applied and fired as described in the cited patents.

In each embodiment of FIGS. 1–8, overglaze is applied and fired as described in the cited patents.

In all embodiments, the terminals are mechanically and electrically connected to circuit boards. They are also, as above-described, stiffly connected to the substrates. The illustrated terminals (terminal pins) and the mechanical connections thereof are sufficiently stiff to hold the substrates vertical. Especially re the embodiment of FIGS. 5–8, the resistor could be bolted or clipped in flatwise engagement with a heatsink—not perpendicular to the circuit board.

The size range of typical resistors is from a minimum of 0.23 inch wide by 0.23 inch high, to a maximum of 2 inches wide by 1 inch high. These dimensions refer to the package, in these cases where there is a housing; otherwise, the dimensions refer to the substrate.

Throughout, for purposes of convenience only, the convention is adopted that the resistors are perpendicular to horizontal circuit boards.

The foregoing detailed description is to be clearly understood as given by way of illustration and example only, the spirit and scope of this invention being limited solely by the appended claims.

What is claimed is:

1. A single resistor of the fracturing type, said resistor comprising:

(a) a thin, flat substrate having such thermal coefficient of expansion that it will fracture in response to thermal stress, said substrate having two opposed edges, (b) a single-resistor resistive film provided on a large part of at least the frontside of said substrate, (c) two and only two terminal means for said resistive film, said terminal means being first and second terminal means, said terminal means connecting to only one of said opposed edges and to said resistive film, (d) first and second cold arms extending generally between said opposed edges and with at least large parts of said arms being in spaced relationship from each other, said cold arms being parts of said substrate that are not subjected to major frontside heating caused by current flowing through said resistive film, said cold arms having at least a substantial part of said resistive film located between them, said substantial part of said resistive film extending to adjacent the other of said opposed edges, said cold arms and said substrate being so dimensioned and so located and so related to each other that a sufficient overload voltage will reliably and repeatably cause said substrate to fracture in the region between said cold arms, and with the direction of fracture being generally between said one opposed edge and said other opposed edge, thereby breaking a circuit through said resistive film between said terminal means.

2. The resistor according to claim 1, in which the portions of said cold arms adjacent said one opposed edge are connected to each other by a cold region of said substrate.

3. The resistor according to claim 2, in which said cold arms and cold region combine to form a general U-shape, said U-shape having a base, with said cold region being said base of said U-shape.

4. The resistor according to claim 3, in which said base has a dimension, in a direction transverse to said one opposed edge, that is substantially equal to or somewhat smaller than the width of each of said cold arms.

5. The resistor according to claim 4, in which a synthetic resin housing is molded around said substrate.

6. The resistor according to claim 1, in which each of said cold arms is at least 0.06 inch wide.

7. The resistor according to claim 1, in which said first and second terminal means are two terminal pins mechanically connected to said one opposed edge, said pins being sufficiently stiff to hold said substrate, and portions thereof, upright, said pins being secured in a circuit board.

8. The resistor according to claim 1, in which a synthetic resin housing is molded around said substrate.

9. A single resistor comprising:

(a) a rectangular, thin, flat substrate having such a thermal coefficient of expansion that it will fracture in response to thermal stress, (b) terminal means mechanically connected to only the bottom edge of said substrate and adapted to hold said substrate on a circuit board, (c) single-resistor resistive film means provided on the frontside of at least a major portion of said substrate, and electrically connected to said terminal means, and (d) first and second cold arm means each extending upwardly from the vicinity of said bottom edge to the vicinity of the top edge of said substrate, said cold arm means being spaced from each other in a direction longitudinal to said substrate, said cold arm means being so located as to divide said resistive film means into three film sections, said film sections being electrically connected to each other, each of said film sections generating substantial frontside heating of said substrate at the portions of said substrate respectively underlying said film sections, each of said cold arm means being such that the portions of said substrate respectively underlying said cold arm means are not subjected to substantial frontside heating, said cold arm means being so dimensioned, located and associated that when a sufficiently high overload voltage is applied to said terminal means, the portion of said substrate underlying one of said film sections is substantially repeatably cracked or fractured in a direction extending between said bottom edge and the top edge of said substrate, thereby breaking a circuit through said one film section.

10. A resistor, comprising:

(a) a square or rectangular substrate having such a thermal coefficient of expansion that it will fracture in response to thermal stresses, (b) resistive film means provided on said substrate, (c) terminal means mechanically connected to only the bottom edge of said substrate and electrically connected to said resistive film means, characterized in that said film means is spaced from said bottom edge of said substrate, further characterized in that said film means is spaced from both side edges of said substrate, further characterized in that there is no high-conductivity trace on said substrate between the top edge of said film means and the top edge of said substrate, and further characterized in that said film means and the spaces below and laterally thereof are such that application of sufficiently high overload voltage to said film means reliably and repeatably causes said substrate to crack along a line extending between said top and bottom edges and through said film means, thereby breaking any circuit through said film means, and (d) synthetic resin housing means molded around said substrate.

11. The invention as claimed in claim 10, in which the top edge of said film means is adjacent the top edge of said substrate.

12. The invention as claimed in claim 11, in which said film means is generally square.

13. The invention as claimed in claim 11, in which said film means is substantially solid.

14. A method of breaking a circuit, said method comprising the steps of:

(a) selecting a thin, flat substrate that has such a thermal coefficient of expansion that it will fracture when sufficient thermal stress is created therein, (b) providing termination means on only one edge portion of said substrate, (c) providing resistive film on said substrate in such pattern, location, and construction that when current passes through said film, there will result in said substrate a generally U-shaped, relatively cold zone largely encompassing a relatively hot zone, the latter resulting from passage of said current through primarily resistive portions of said film that are largely encompassed by said cold zone, and further causing said cold zone and hot zone to be such that in response to application of sufficient overload voltage to said termination means, said zones will cause a crack to form in said substrate between said one edge and a substrate edge that is generally opposed to said one edge, said crack extending through said film to break the circuit through said film, and (d) connecting said termination means into an electric circuit in which said sufficient overload voltage may occur.

* * * * *